US012397954B2

(12) United States Patent
Hilbrink et al.

(10) Patent No.: US 12,397,954 B2
(45) Date of Patent: Aug. 26, 2025

(54) METHOD AND SYSTEM FOR MANUFACTURING A NUMBER OF TUBULAR PACKAGINGS FILLED WITH A LIQUID

(71) Applicant: MU-DROP B.V., Apeldoorn (NL)

(72) Inventors: Hubertus Eduard Hilbrink, Apeldoorn (NL); Leonardus Hubertus Maria Lammers, Hoofddorp (NL)

(73) Assignee: MU-DROP B.V., Apeldoorn (NL)

( * ) Notice: Subject to any disclaimer, the term of this patent is extended or adjusted under 35 U.S.C. 154(b) by 362 days.

(21) Appl. No.: 17/794,149

(22) PCT Filed: Jan. 22, 2021

(86) PCT No.: PCT/NL2021/050041
§ 371 (c)(1),
(2) Date: Jul. 20, 2022

(87) PCT Pub. No.: WO2021/150114
PCT Pub. Date: Jul. 29, 2021

(65) Prior Publication Data

US 2023/0070904 A1 Mar. 9, 2023

(30) Foreign Application Priority Data

Jan. 23, 2020 (NL) ..... 2024745

(51) Int. Cl.
*B65B 51/30* (2006.01)
*B65B 9/12* (2006.01)
*B65B 9/14* (2006.01)

(52) U.S. Cl.
CPC ..... *B65B 51/303* (2013.01); *B65B 9/12* (2013.01); *B65B 9/14* (2013.01)

(58) Field of Classification Search
CPC ..... B65B 9/12; B65B 9/14; B65B 51/303
(Continued)

(56) References Cited

U.S. PATENT DOCUMENTS 4,045,939 A * 9/1977 Baumstingl ..... B65B 31/02 53/426
2003/0093971 A1* 5/2003 Terminella ..... B29C 66/849 53/133.4

FOREIGN PATENT DOCUMENTS

EP 1442979 A1 4/2004
WO 2008089762 A1 7/2008
WO 2018208152 A1 11/2018

OTHER PUBLICATIONS

International Search Report and Written Opinion for PCT/NL2021/050041 dated Mar. 10, 2021 (12 pages).

* cited by examiner

*Primary Examiner* — Anna K Kinsaul
*Assistant Examiner* — Mary C Hibbert-Copeland
(74) *Attorney, Agent, or Firm* — KDW Firm PLLC

(57) ABSTRACT

A method for manufacturing a number of tubular packagings filled with a liquid, particularly a sterile liquid. The method includes providing a tube which is wound onto a first reel and is filled at least partially with the liquid, and unwinding the tube from the first reel and dividing it into a number of tubular segments by means of successive welding operations. The tube is displaceable through a welding device substantially vertically and substantially free of mechanical tension. A temperature prevailing in the welding device can be kept constant during each welding operation by having liquid circulate through the welding device. One or more welding parameters can further be recorded during each welding operation and be stored together with data about the liquid. A system for performing this method.

20 Claims, 3 Drawing Sheets

Figure 1:
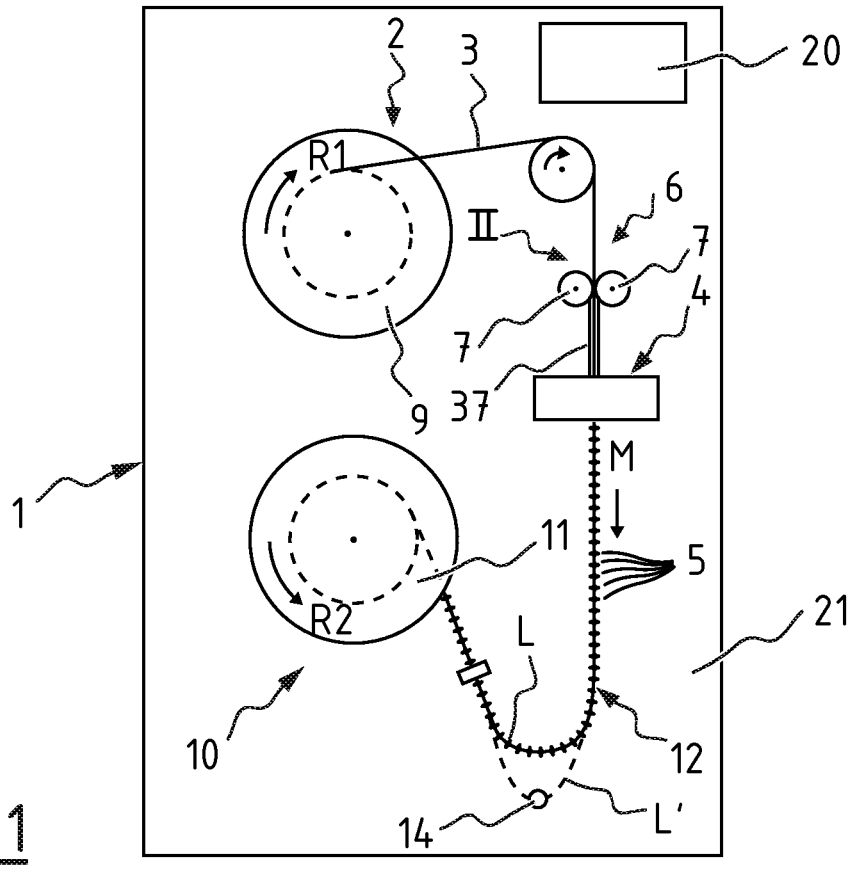

(58) Field of Classification Search
USPC ..... 53/450
See application file for complete search history.

METHOD AND SYSTEM FOR MANUFACTURING A NUMBER OF TUBULAR PACKAGINGS FILLED WITH A LIQUID

This application is a national stage filing under 35 U.S.C. 371 of pending International Application No. PCT/NL2021/050041, filed Jan. 22, 2021, which claims priority to Netherlands Patent Application No. 2024745, filed Jan. 23, 2020, the entirety of which applications are incorporated by reference herein.

The invention relates a method for manufacturing a number of tubular packagings filled with a liquid, particularly a sterile liquid, comprising the steps of providing a tube which is wound onto a first reel and is filled at least partially with the liquid, and unwinding the tube from the first reel and dividing it into a number of tubular segments by means of successive welding operations. Such a method is known from WO 2018/208152 A1.

With the known method it is possible to form a string of a large number of tubular packagings, which are each filled with liquid and which are connected to other packagings on either side by welding, in a short time. These packagings can then be separated from each other at a later stage by cutting or tearing the welded connections.

From EP 1 442 979 A1 a preforming apparatus is known which allows smooth travel of a packaging material. The preforming apparatus includes first to fourth guides for forming a web-like packaging material into a tubular packaging material; a longitudinal sealing device for longitudinally sealing the tubular packaging material; a drive unit; and a tube guide device disposed in such a manner as to surround the tubular packaging material, and guiding the tubular packaging material while being driven by means of the drive unit. Activation of the drive unit causes the tube guide device to guide and feed the packaging material, thereby preventing the tube guide device from resisting travel of the packaging material. Thus, the tube guide device does not yield a braking effect, thereby allowing smooth travel of the packaging material. Also, high tension along the traveling direction of the packaging material does not arise in the packaging material when the packaging material travels between the tube guide device and the first or second sealing jaw device.

WO 2008/089762 A1 discloses a method and an apparatus for making a medium-filled packaging of two superposed heat-sealable elongated webs of plastic film which are thermally sealed in longitudinal and transverse directions of the film webs for forming packagings, and where the formed packagings are filled by medium and closed. The film webs are passed between a pair of rollers which are pressed against each other, retaining the film webs therebetween. Thermal sealing across part of the width of the film webs is performed so that unbroken longitudinal areas without any thermal sealing appear in the longitudinal direction of the film webs. The medium is filled into the packaging before closing it for the formation of the medium-filled packaging.

The invention has for its object to further develop and expand a method of the above described type. According to the invention, this is achieved in that the tube is displaced through a welding device substantially vertically and substantially free of mechanical tension. Keeping the tube free of mechanical or external tensions during displacement effectively avoids loads due to which the recently formed welded connections could still break. The vertical orientation of the tube also achieves that gas bubbles which may be present in the liquid will rise and will not reach the welding device, so that they will not end up in the packagings either.

The tube can here be displaced by exerting thereon upstream of the welding device a pressure force directed toward the welding device. Tensile forces on the tube and the welded connections formed therein are thus also prevented.

The tube can be displaced uniformly by passing it between profiled conveyor rollers. The speed of displacement of the tube can hereby be precisely controlled.

During the displacement through the profiled conveyor rollers the tube can also be temporarily deformed. The conveyor rollers can for instance each have a V-shaped groove, whereby the round cross-section of the tube temporarily changes to a diamond-shaped cross-section.

When the tube is wound onto a second reel after each welding operation, it can be transported or stored in simple manner, not just prior to but also after the tube being divided into tubular segments. The unwinding and the winding can here be controlled and performed independently of each other, whereby tensions can also be prevented from arising in the tube.

The vertical orientation of the tube can be achieved when the first reel is located at a greater height than the second reel.

In order to further avoid stresses in the tube and in the welded connections the tube can be passed through a buffer between the welding device and the second reel. During and after each welding operation the welded connections are thus loaded only by the weight of the already welded segments, with a total mass in the order of grams.

In order to finally be able to wind the string of tubular segments compactly onto the second reel again it can be biased between the buffer and the second reel.

A temperature prevailing in the welding device can be kept substantially constant during each welding operation by having liquid circulate through the welding device. With such a liquid cooling the plastic material of the tube can be kept cool, even in the case of a large number of welding operations per unit of time. This is particularly important in the case of high-frequency welding, since the absorption of high-frequency energy by plastic increases at higher temperatures, whereby variations are increased rather than reduced.

When each welding operation is performed by means of two electrodes placed on opposite sides of the tube, it is preferred that the temperature of the two electrodes is kept substantially the same. A symmetrical heating of the material of the tube is hereby achieved, so that the welded connection is in each case formed exactly halfway between the electrodes. The electrodes can here also take a symmetrical form relative to the tube, this further enhancing the symmetry of the heating.

Finally, one or more welding parameters can be recorded during each welding operation and be stored together with data about the liquid in the tube. Information regarding the quality of the individual welded connections, and thereby of the liquid-filled packagings belonging to a determined group or batch, can be derived from the stored values of the welding parameters at any desired moment.

At least a part of the stored parameters and/or data can be arranged on the second reel so that, in further use of the packagings, information about the quality thereof is always available.

The invention further relates to a system for manufacturing a number of tubular packagings filled with a liquid, particularly a sterile liquid, comprising a feed device with a first reel for feeding a tube wound on the first reel and filled at least partially with the liquid, and a welding device for dividing the tube into a number of tubular segments by means of successive welding operations. Such a method is likewise known from WO 2018/208152 A1.

According to the invention, this system is provided with displacing means co-acting with the welding device for the purpose of displacing the tube through the welding device substantially free of mechanical tensions, wherein the displacing means are configured to displace the tube substantially vertically through the welding device.

Finally, the invention also relates to displacing means, temperature control means and recording means which are evidently intended for application in the system as described above.

Figure 2:
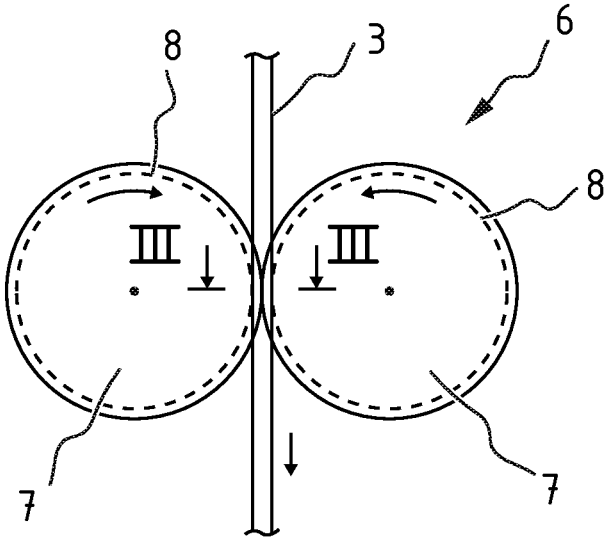
Figure 3:
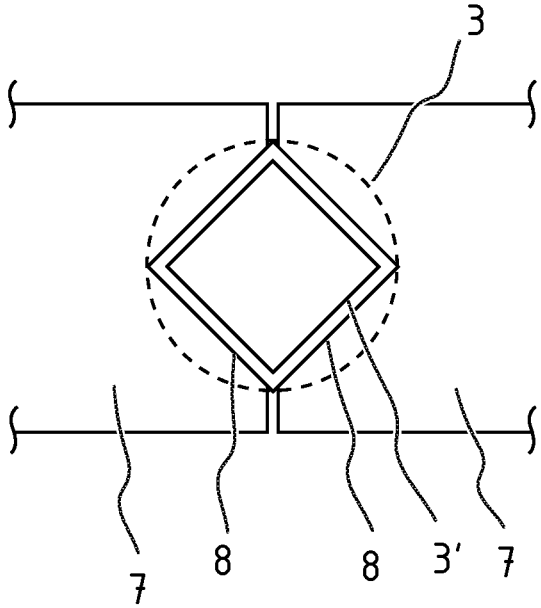
Figure 4:
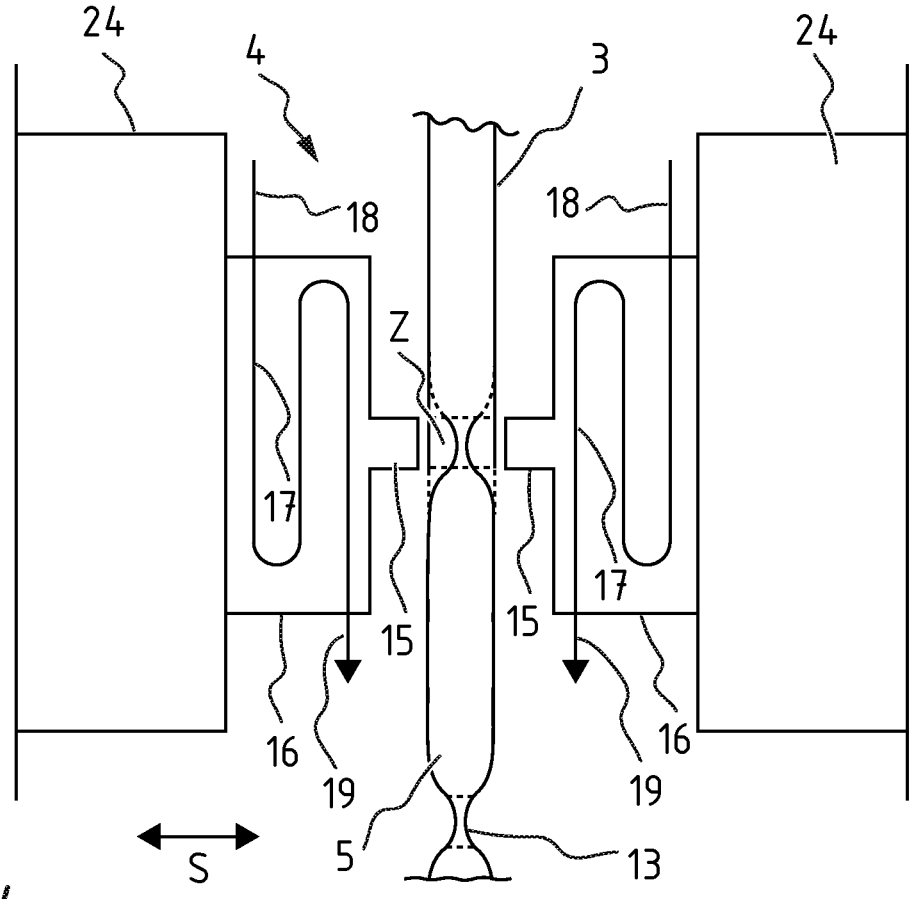
Figure 5:
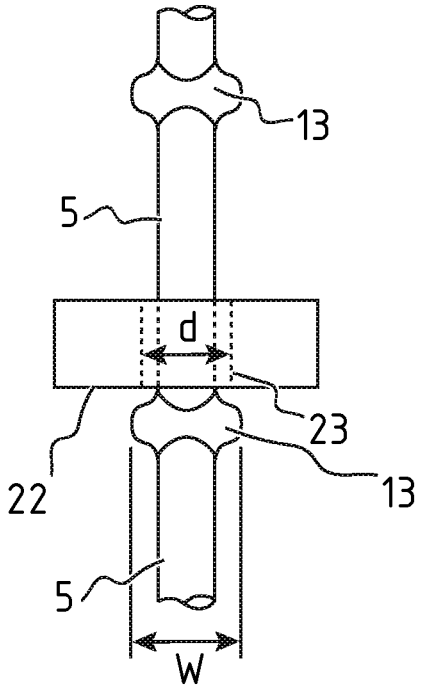
Figure 6:
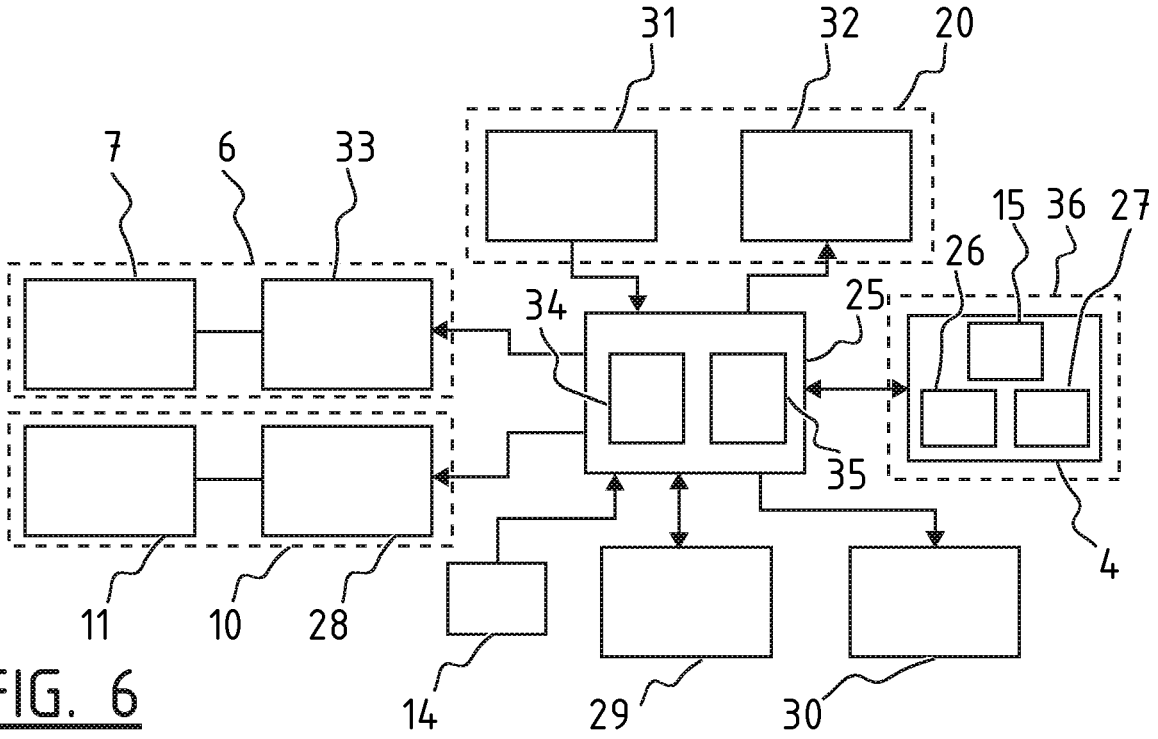

The invention will now be elucidated on the basis of an embodiment, wherein reference is made to the accompanying drawing, in which:

FIG. 1 is a schematic front view of a system for manufacturing a number of tubular packagings filled with a sterile liquid according to an embodiment of the invention, FIG. 2 is a detail view on enlarged scale as according to arrow II in FIG. 1, FIG. 3 is a cross-section along the line III-III in FIG. 2, FIG. 4 is a schematic view of electrodes of the welding device of the system of FIG. 1, FIG. 5 shows schematically a biasing member between a buffer and a take-up reel, and FIG. 6 shows schematically the different components of the system according to the invention.

A system 1 for manufacturing a number of tubular packagings filled with a liquid, particularly a sterile liquid, comprises a feed device 2 for feeding a tube 3 filled at least partially with the liquid, and a welding device 4 for dividing tube 3 into a number of tubular segments 5 by means of successive welding operations (FIG. 1). According to a first aspect of the invention, system 1 is further provided with displacing means 6 co-acting with welding device 4 for the purpose of displacing tube 3 through welding device 4 free of mechanical or external tensions. The direction of displacement of tube 3 is indicated with arrow M. In the shown example displacing means 6, which are configured to displace the tube by exerting a pressure force directed towards welding device 4 upstream of the welding device, comprise two profiled conveyor rollers 7 placed on either side of tube 3 (FIG. 2).

The conveyor rollers 7, which are driven rotatingly in opposite directions by a drive 33 (FIG. 6), are here each provided with a V-shaped groove 8 in their periphery. Conveyor rollers 7 on either side of tube 3 thus together form a profile which differs from the cross-sectional profile of tube 3. The round cross-section of tube 3 (shown in broken lines in FIG. 3) are hereby temporarily deformed into a diamond-shaped or even square cross-section when passing conveyor rollers 7 (shown with full lines in FIG. 3). Owing to this local change in cross-section the conveyor rollers 7 have a good grip on the periphery of tube 3, whereby they can accurately transport tube 3 through an infeed tube 37 to welding device 4 at the desired speed.

Feed device 2 comprises here a first reel 9 and system 1 further comprises a take-up device 10 with a second reel 11. First reel 9 and second reel 11 are placed on different sides of welding device 4 and can be provided with their own drives. It is also possible for one of the two reels 9, 11 to be driven and for the other reel to be mounted in freely rotating manner, as in this example, or even to be braked. In this case the displacement of tube 3 through welding device 4 is realized exclusively by the driven conveyor rollers 7, and supply reel 9 can take a freely rotating form. Take-up reel 11 is provided with a drive 28 (FIG. 6) which, just as the drive 33 of conveyor rollers 7, is controlled by a control 25 of system 1.

By making use of a supply reel 9 and a take-up reel 11 tube 3 can be easily handled prior to being placed in system 1, while the string of tubular segments 5 is subsequently likewise easy to handle before being divided into individual tubular packagings in another device. Supply reel 9 and take-up reel 11 are here rotatable in opposite directions as according to the arrows R1, R2, so that supply reel 9 is unwound on its upper side from outside to inside, while take-up reel 11 is likewise wound on its upper side, from inside to outside. The winding direction of tube 3 on supply reel 9 is thereby the same as the winding direction of the string of tubular segments 5 on take-up reel 11, so that the two reels 9, 11 can be handled in similar manner.

According to an aspect of the invention, displacing means 6 are configured to displace tube 3 substantially vertically through welding device 4. In the shown system this is achieved in that the first reel 9 is placed in system 1 at a greater height than second reel 11.

System 1 is here further provided with a buffer 12 placed between welding device 4 and second reel 11. This buffer 12 is here formed by having the string of tubular segments 5 hang below welding device 4 in a loop L before winding it onto take-up reel 11. The speed at which the string of tubular segments 5 is wound onto take-up reel 11 can thus be disconnected from the speed at which welded connections 13 are formed between segments 5 in welding device 4. Welded connections 13 can hereby have sufficient time to cool before they are loaded by being wound onto take-up reel 11. The only load that is exerted on the new welded connections 13 between welding device 4 and buffer 12 is the weight of the string of tubular segments 5, which is in the order of several grams. The string is thus substantially free of stresses, in any case during the welding operation.

With each welding operation the length of loop L increases, until it has dropped so far down (indicated with broken lines and the letter L') that it passes a sensor 14, for instance a light beam. This sensor 14 is here connected to control 25, which in turn controls the drive 28 of take-up reel 11 so that a part of the string is wound again.

In order to be able to wind the string of tubular segments 5 in sufficiently compact manner a biasing member 22 is in the shown example arranged between buffer 12 and take-up reel 11, whereby the string is brought to bias prior to the winding. At this point the welded connections 13 have already cooled and hardened enough to be placed under strain of tension. Biasing member 22 thus in fact forms a transition between the tension-free part of the path travelled by the string—i.e. the part from conveyor rollers 7 through welding device 4 and through buffer 12—and the part of the path where the string is (lightly) loaded again. In this example biasing member 22 has a continuous opening 23 through which the string is carried. This opening 23 has a diameter d which is slightly smaller than a width W of each welded connection 13 so that the string get stuck for a moment and is thereby biased when it passes opening 23.

According to an aspect of the invention, system 1 can be provided with temperature control means 36 for keeping a temperature prevailing in welding device 4 substantially constant during each welding operation. In the shown example these temperature control means 36 are configured to circulate liquid through welding device 4. Such a liquid cooling has a greater cooling capacity than a conventional air cooling. This is important because system 1 according to the invention is configured to perform a large number of welding operations in a relatively short time, for instance 1000 welds per hour. Welding device 4 would hereby heat up rapidly if it were not cooled effectively.

In this example welding device 4 has two electrodes 15 placed on opposite sides of tube 3, one of which is fixed and the other of which can perform a reciprocal stroke as according to arrow S (FIG. 4). The temperature control means are therefore configured to keep the temperature of the two electrodes 15 substantially constant, but additionally also to keep the temperatures on either side of tube 3 the same as far as possible. This is important in order to ensure that tube 3 is heated symmetrically from two sides, whereby welded connection 13 will be formed exactly halfway between the two electrodes 15.

Temperature control means 36 comprise here two bodies 16 of a readily conductive material, for instance aluminium, in which are formed channels 17 through which the cooling liquid can flow from a connection 18 on the inflow side to a connection 19 on the outflow side. Each electrode 15 is here formed as a whole with the body 16, whereby an excellent heat transfer is ensured. Electrodes 15 and cooling bodies 16 moreover take a relatively small form, whereby they have a low heat content and thus heat up and cool down rapidly. An optimal temperature control is thus ensured. An additional factor here is that each electrode 15 with associated cooling body 16 is separated from the other parts of system 1 by an insulator 24 so that the temperature of the electrode is not influenced by the surrounding parts of system 1.

In the shown example the temperature control means 36 act not only to control the temperature of electrodes 15, but also the temperature of the other components of welding device 4, particularly the generator 26, which generates a lot of heat and thus requires a lot of cooling. In the shown example this generator 26 is thus likewise liquid-cooled, just as electrodes 15. Frequency controller 27 of welding device 4 can also be connected to temperature control means 36.

According to yet another aspect of the invention, the whole welding device 4, so including generator 26, frequency controller 27 and electrodes 15, can be received releasably in system 1. Welding device 4 can thus be released and exchanged in rapid and simple manner in the case of a malfunction or for periodic maintenance. Repairs and maintenance operations then need not be carried out on location but can be performed in a specialized workshop, while system 1 is once again ready for use after a replacement welding device 4 has been installed.

Finally, according to an aspect of the invention, the system can be provided with recording means connected to welding device 4 for the purpose of recording one or more welding parameters during each welding operation and for the purpose of storing the recorded values of the welding parameters together with data about the liquid packaged in tube 3, which will originate from a known source. This information can be stored in a memory 35 or on a storage medium 29. The recording means can form part of the already stated control 25 of system 1. This control 25, which comprises in usual manner a processor 34 and said memory 35, can send control signals to and receive welding parameters from welding device 4.

A user of the system can communicate with this control via a GUI (graphical user interface) 20 which is shown schematically here and wherein input means 31 and display means 32 are combined.

The recording means can be configured to arrange on the second reel 11 a summary of the stored information, which forms an indication of the quality and integrity of the tubular segments 5 which in a subsequent step are transformed into tubular packagings with liquid. In addition to data about the tube 3 with the liquid and the welding parameters, data of the system 1 used can also be stored and arranged on the second reel 11. For this purpose the system can be provided with a printing unit 30 whereby all necessary data can be printed on a sticker which is then stuck on reel 11. The recorded values can also be transferred electronically to other systems in the production chain in the form of a so-called Batch Manufacturing Record (BMR).

In the shown example system 1 is otherwise received in an upright housing or cabinet 21, the front side of which is shown in FIG. 1. All drives, feeds, controls and the like are built into the cabinet 21, which can also be closed on the front side with a door, thus protecting all elements of system 1 against unintended manipulation. This is of particularly great importance in the processing of sterile liquids. The door can be at least partially transparent so that the welding process can be monitored from the outside. System 1 can be configured to switch itself off when the door is opened.

The method and the system according to the invention thus make it possible to divide a tube which is filled with liquid into a large number of individual tubular packagings which are filled with liquid in rapid and simple manner, on industrial scale, with very high quality and repeatability, and in completely sterile manner.

Although the invention has been elucidated above on the basis of an embodiment, this can be varied in many ways. The different aspects of the invention which have been described and shown can be applied both in combination and individually, while maintaining the associated effect. The scope of the invention is therefore defined solely by the following claims.

The invention claimed is:

1. A method for manufacturing a number of tubular packagings filled with a liquid, comprising the steps of:

providing a tube which is wound onto a first reel and is filled at least partially with the liquid, and unwinding the tube from the first reel and dividing it into a number of tubular segments by means of successive welding operations, wherein the tube is displaced through a welding device substantially vertically and substantially free of mechanical tension, and wherein the tube is wound onto a second reel after each welding operation.

2. The method according to claim 1, wherein the tube is displaced by exerting thereon upstream of the welding device a pressure force directed toward the welding device.

3. The method according to claim 1, wherein the tube is displaced by means of profiled conveyor rollers.

4. The method according to claim 3, wherein the tube is temporarily deformed during the displacement through the profiled conveyor rollers.

5. The method according to claim 1, wherein the first reel is located at a greater height than the second reel.

6. The method according to claim 1, wherein the tube is passed through a buffer between the welding device and the second reel, and optionally wherein the tube is biased between the buffer and the second reel.

7. The method according to claim 1, wherein one or more welding parameters are recorded during each welding operation and stored together with data about the liquid, and optionally wherein at least a part of the stored parameters and/or data is arranged on the second reel.

8. A method, for manufacturing a number of tubular packagings filled with a liquid, comprising the steps of:

providing a tube which is wound onto a first reel and is filled at least partially with the liquid, and unwinding the tube from the first reel and dividing it into a number of tubular segments by means of successive welding operations, wherein the tube is displaced through a welding device substantially vertically and substantially free of mechanical tension, and wherein a temperature prevailing in the welding device is kept substantially constant during each welding operation by having liquid circulate through the welding device.

9. The method according to claim 8, wherein each welding operation is performed by means of two electrodes placed on opposite sides of the tube, and the temperature of the two electrodes is kept substantially the same.

10. A system for manufacturing a number of tubular packagings filled with a liquid, comprising:

a feed device with a first reel for feeding a tube wound on the first reel and filled at least partially with the liquid, and a welding device for dividing the tube into a number of tubular segments by means of successive welding operations, further comprising displacing means co-acting with the welding device for the purpose of displacing the tube through the welding device substantially free of mechanical tension, wherein the displacing means are configured to displace the tube substantially vertically through the welding device, and further comprising a take-up device with a second reel, wherein the first and second reel are placed on different sides of the welding device.

11. The system according to claim 10, wherein the displacing means are configured to displace the tube by exerting thereon upstream of the welding device a pressure force directed toward the welding device.

12. The system according to claim 10, wherein the displacing means comprise profiled conveyor rollers placed on either side of the tube.

13. The system according to claim 12, wherein the profiled conveyor rollers on either side together form a profile which differs from a cross-sectional profile of the tube.

14. The system according to claim 10, wherein the feed device and the take-up device each comprise their own drive.

15. The system according to claim 10, further comprising a buffer placed between the welding device and the second reel, and optionally further comprising a biasing member which is placed between the buffer and the second reel and engages the tube.

16. The system according to claim 10, wherein the welding device is received releasably in the system.

17. The system according to claim 10, further comprising recording means connected to the welding device for the purpose of recording one or more welding parameters during each welding operation and for the purpose of storing the recorded welding parameters together with data about the liquid, and optionally wherein the recording means are configured to arrange on the second reel at least a part of the stored parameters and/or data.

18. The system according to claim 10, wherein the first reel is placed at a greater height than the second reel.

19. A system for manufacturing a number of tubular packagings filled with a liquid, comprising:

a feed device with a first reel for feeding a tube wound on the first reel and filled at least partially with the liquid, and a welding device for dividing the tube into a number of tubular segments by means of successive welding operations, further comprising displacing means co-acting with the welding device for the purpose of displacing the tube through the welding device substantially free of mechanical tension, wherein the displacing means are configured to displace the tube substantially vertically through the welding device, and further comprising temperature control means for keeping a temperature prevailing in the welding device substantially constant during each welding operation, which temperature control means are configured to circulate liquid through the welding device.

20. The system according to claim 19, wherein the welding device comprises two electrodes placed on opposite sides of the tube, and the temperature control means are configured to keep the temperature of the two electrodes substantially the same.

* * * * *